US007811645B2

(12) United States Patent
Shi

(10) Patent No.: US 7,811,645 B2
(45) Date of Patent: Oct. 12, 2010

(54) PACKAGED BEVERAGE HAVING ENHANCED CARBON DIOXIDE RETENTION, METHOD FOR PACKAGING A BEVERAGE, CONTAINER FOR PACKAGING A BEVERAGE, AND POLYESTER COMPOSITION

(75) Inventor: Yu Shi, Alpharetta, GA (US)

(73) Assignee: The Coca-Cola Company, Atlanta, GA (US)

( * ) Notice: Subject to any disclaimer, the term of this patent is extended or adjusted under 35 U.S.C. 154(b) by 1044 days.

(21) Appl. No.: 11/068,483

(22) Filed: Feb. 28, 2005

(65) Prior Publication Data

US 2005/0196500 A1 Sep. 8, 2005

Related U.S. Application Data

(60) Provisional application No. 60/549,318, filed on Mar. 2, 2004.

(51) Int. Cl.
*B32B 1/02* (2006.01)
*B65D 85/73* (2006.01)
*B65D 85/00* (2006.01)

(52) U.S. Cl. ..... 428/35.7; 426/106; 426/474

(58) Field of Classification Search ..... 428/35.7; 426/397, 477, 561, 106, 474; 99/275, 323.1; 141/4; 261/DIG. 7
See application file for complete search history.

(56) References Cited

U.S. PATENT DOCUMENTS 4,147,808 A 4/1979 Liepa et al.
4,462,947 A 7/1984 Huggard
4,465,793 A * 8/1984 Brennan et al. ..... 521/172
4,664,922 A 5/1987 Leon et al.
4,965,302 A * 10/1990 Hirahara et al. ..... 524/83
5,473,161 A 12/1995 Nix et al.
5,855,942 A 1/1999 Rule
2003/0194517 A1 10/2003 Shi et al.

FOREIGN PATENT DOCUMENTS

GB 970376 9/1964
GB 1382896 2/1975
WO WO 2004/020519 A1 3/2004

* cited by examiner

*Primary Examiner*—Rena L Dye
*Assistant Examiner*—Erik Kashnikow
(74) *Attorney, Agent, or Firm*—Sutherland Asbill & Brennan LLP

(57) ABSTRACT

A packaged aqueous carbonated beverage comprising a container which replaces at least a portion of $CO_2$ that permeates through the container or closure. The container comprises a polyester composition including a polyester suitable for packaging aqueous carbonated beverages and a carbonating agent. The aqueous carbonated beverage is disposed in the container such that the aqueous carbonated beverage has direct contact with the container and a closure seals the beverage in the container. The carbonating agent reacts with water in the carbonated beverage forming $CO_2$ for replacing at least a portion of $CO_2$ that permeates through the container or closure. A corresponding method of packaging an aqueous carbonated beverage is disclosed.

20 Claims, 2 Drawing Sheets

PACKAGED BEVERAGE HAVING ENHANCED CARBON DIOXIDE RETENTION, METHOD FOR PACKAGING A BEVERAGE, CONTAINER FOR PACKAGING A BEVERAGE, AND POLYESTER COMPOSITION

CROSS-REFERENCE TO RELATED APPLICATIONS

This application claims priority under 35 U.S.C. §119(e) to U.S. Provisional Application 60/549,318 filed on Mar. 2, 2004, the disclosure of which is expressly incorporated by reference in its entirety.

FIELD OF THE INVENTION

This invention relates to a packaged aqueous carbonated beverages and more particularly to enhancing the carbon dioxide retention of such beverages and thereby increasing their shelf life.

BACKGROUND OF THE INVENTION

Polyethylene terephthalate based copolyesters (PET) have been widely used to make containers for carbonated soft drink, juice, water and the like due to their excellent combination of clarity, mechanical and gas barrier properties. However, the use of PET containers for the carbonated soft drink (CSD) has been limited due to the fact that $CO_2$ can permeate through a PET container fairly quickly. The permeation rate of the $CO_2$ in a CSD through a PET container at room temperature is in the range of 3 to 20 cc/day depending on the size of the container, or at a relative loss rate of 1.4 to 2.5%/week when normalized to the starting $CO_2$ level. The relative loss rate depends on the container size, or rather the surface area to volume ratio. The higher the surface area to volume ratio, the higher the relative loss rate. A smaller sized container has a larger surface area/volume ratio thus resulting in a higher relative loss rate. For this reason, PET containers are currently used only as larger sized containers for CSD while metal cans and glass containers are the choice of the smaller sized packages.

The shelf life of a bottled CSD is determined by the amount of $CO_2$ remaining in the beverage. Normally for a CSD, the containers are filled with a $CO_2$ level of 4 volumes $CO_2$/volume $H_2O$ (which is conveniently called 4 volumes of $CO_2$). When 17.5% of $CO_2$ in the bottle is lost or a $CO_2$ level of 3.3 volumes is reached due to $CO_2$ permeation through the container sidewall and closure, the product reaches the end of its shelf life. In the case of beverages with lower carbonation levels, a $CO_2$ level of 2 to 2.5 volumes $CO_2$/volume $H_2O$ is normally required and a certain amount of $CO_2$ loss marks the shelf life of the products. In all the cases, the amount of $CO_2$ left in the container determines the shelf life of the beverage and thus the suitability of PET as a packaging material.

To prevent the $CO_2$ loss, there have been many barrier technologies developed or being developed that try to enhance the barrier of the PET containers to small molecules such as $CO_2$. Regardless of the mechanisms, these barrier technologies all intend to slow down the permeation of $CO_2$ through the container sidewall or slow down the loss of $CO_2$ inside the container. This, however, does not change the total amount of $CO_2$ that the beverage can afford to lose for the beverage product to have an acceptable quality. For example, for a 500 ml bottle filled with 4 volumes of $CO_2$/volume of water, the amount of $CO_2$ loss that can be tolerated before the product reaches its maximum shelf life is 350 ml. The barrier technologies only extend the time it takes this amount of $CO_2$ loss through the sidewall. The total amount of tolerable $CO_2$ loss, 350 ml, will not change based on different barrier technologies used. In addition, almost all of the practically available barrier technologies today require capital investment and add substantial cost to container manufacturer.

GB 0 970 376 discloses a beverage with an added bactericide that hydrolyzes to form $CO_2$ and a compatible alcohol. A suitable bactericide is pyrocarbonic acid diethylester which hydrolyzes in an aqueous solution to form ethyl alcohol and carbonic acid. The disclosure claimed that a beverage treated with this method had an extended shelf life. The rate of the carbonation release for these additives in a carbonated beverage, however, is substantially higher than the loss of the $CO_2$ through permeation. The sudden rise of the $CO_2$ level is therefore beyond the acceptable quality level.

U.S. Pat. No. 5,855,942 discloses a method and composition for enhancing the retention of $CO_2$ in carbonated beverages via addition of a carbonic acid ester in the beverage. The carbonic acid esters release $CO_2$ through the acid catalyzed hydrolysis of the carbonic acid ester in the acid aqueous environment of the carbonated beverage. The release of $CO_2$ is claimed to occur at the similar rate of $CO_2$ permeation through the sidewall.

The above technologies, while generating $CO_2$ to compensate the $CO_2$ loss through the sidewall and closure, are not practical and are very difficult to use. The addition of any compound in the beverage alters the beverage composition. Alteration of the beverage not only dramatically affects the taste and the nature of the beverage, but the added compounds also have to be compatible with the beverage product so that no solid deposits form and cloud the beverage product. Changing the beverage composition can also create regulatory issues, if the additives are not compliant with the regulations or form toxic by-products as a result of the reaction.

Thus, there remains a need for a simple and effective system of compensating for $CO_2$ loss in packaged CSD without adversely affecting the CSD composition.

SUMMARY OF THE INVENTION

This invention addresses the above-described need by providing a polyester composition including a polyester and a carbonating agent that reacts with water when liquid water or an aqueous composition directly contacts the polyester composition.

More particularly, this invention encompasses a container comprising a polyester composition comprising a polyester suitable for packaging aqueous carbonated beverages and a carbonating agent, wherein the carbonating agent reacts with water when liquid water or an aqueous carbonated beverage directly contacts the container. Such a container is well suited for packaging aqueous carbonated beverages to replace at least a portion of $CO_2$ that is lost from the packaged beverage via permeation. Thus, according to an embodiment of this invention, a packaged aqueous carbonated beverage is provided and comprises a container which replaces at least a portion of $CO_2$ that permeates through the container or closure. The aqueous carbonated beverage is disposed in the container such that the aqueous carbonated beverage has direct contact with the container and a closure seals the beverage in the container. The carbonating agent reacts with water in the carbonated beverage forming $CO_2$ for replacing at least a portion of $CO_2$ that permeates through the container or closure.

This invention further comprises a corresponding method of packaging an aqueous carbonated beverage. This method comprises the steps of filling a container with an aqueous carbonated beverage such that the aqueous carbonated beverage has direct contact with the container, the container comprising a polyester composition comprising a polyester suitable for packaging aqueous carbonated beverages and a carbonating agent, and sealing the beverage in the container with a closure. The carbonating agent reacts with water in the carbonated beverage forming $CO_2$ for replacing at least a portion of $CO_2$ that permeates through the container or closure.

In the embodiment for packaging aqueous carbonated beverages, the carbonating agent in the polyester composition can react with water when in contact with the beverage, or react with water that diffuses into the sidewall of the container, to form $CO_2$ which replaces $CO_2$ lost from the container through permeation. The incorporated carbonating agent hydrolyzes to form $CO_2$ when in contact with the water in the beverage or hydrolyzes by water diffused through the container sidewall. The carbonating agent thereby enhances $CO_2$ retention in the beverage package. Therefore, the carbonating agent extends the $CO_2$ retention and shelf life of the beverage without altering the composition of the beverage.

Other objects, features, and advantages of this invention will become apparent from the following detailed description, drawings, and claims.

DETAILED DESCRIPTION OF THE INVENTION

Figure 1:
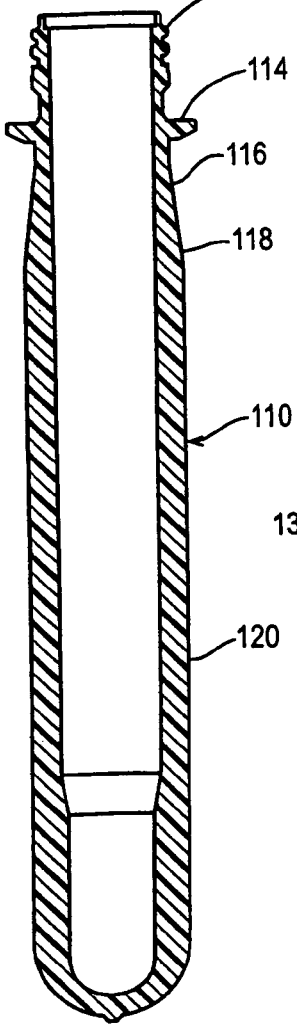
FIG. 1 is a sectional elevational view of a molded container preform made in accordance with an embodiment of this invention.

As summarized above, the present invention encompasses a container that is useful for packaging an aqueous carbonated beverage. The container is made from a polyester composition that includes a polyester and a carbonating agent that reacts with water in the carbonated beverage to form $CO_2$ which replaces at least a portion of $CO_2$ that has permeated through the sidewall or closure of the container. This invention further encompasses a packaged beverage comprising an aqueous carbonated beverage disposed in a container, which includes a carbonating agent as described above, and a corresponding method of packaging an aqueous carbonated beverage. Furthermore, this invention encompasses a polyester composition comprising a polyester and a carbonating agent that reacts with water from liquid water or an aqueous carbonated beverage to form $CO_2$.

More particularly, the container of this invention comprises a polyester composition including a polyester suitable for packaging aqueous carbonated beverages and a carbonating agent. The carbonating agent reacts with water in the carbonated beverage forming $CO_2$ which replaces at least a portion of $CO_2$ that has permeated through the sidewall or closure of the container and thereby extends the shelf-life of the packaged beverage.

The polyester composition comprises any polyester that is suitable for packaging aqueous carbonated beverages and has $CO_2$ loss through permeation of the sidewall or closure. In preferred embodiments, the polyester is a poly(ethylene terephthalate) based copolyester (PET copolyester) having less than 20 mole % diacid and/or 10 mole % diol modification, based on 100 mole % diacid component and 100 mole % diol component. In other words, in one preferred embodiment, the polyester is PET copolyester having less than 20 mole % diacid modification, based on 100 mole % diacid component and 100 mole % diol component. In another preferred embodiment, the polyester is PET copolyester having less than 10 mole % diol modification, based on 100 mole % diacid component and 100 mole % diol component. In yet another embodiment, the polyester is PET copolyester having less than 20 mole % diacid and less than 10 mole % diol modification, based on 100 mole % diacid component and 100 mole % diol component. Diacid modifiers that may be added to the PET copolyester include but are not limited to adipic acid, succinic acid, isophthalic acid, phthalic acid, 4,4'-biphenyl dicarboxylic acid, 2,6-naphthalenedicarboxylic acid, and the like. Suitable diol modifiers include but are not limited to cyclohexanedimethanol, diethylene glycol, 1,2-propanediol, neopentylene glycol, 1,3-propanediol, and 1,4-butanediol, and the like.

In preferred embodiments, the carbonating agent is an organic carbonate selected from the group consisting of carbonic acid esters and organic carbonic acid salts. In another preferred embodiment, the carbonating agent is a polymeric carbonic acid ester. Suitable carbonating agents include, but are not limited to, alkylene carbonates and dialkane carbonates, such as propylene carbonate, 1,3 butylene carbonate, diethyl carbonate, dipropyl carbonate, dibutyl carbonate, and neo-pentylene carbonate, and polycarbonates, especially aliphatic polycarbonates, and the like.

In preferred embodiments, the carbonating agent is present in the polyester composition at levels from about 1 to about 15% by weight of the polyester composition, more preferably from about 2 to about 15% by weight of the polyester composition, and even more preferably from about 3 to about 10% by weight of the polyester composition. Conversely, the polyester is preferably present in the polyester composition at levels from about 99 to about 85% by weight of the polyester composition, more preferably from about 98 to about 85% by weight of the polyester composition, and even more preferably from about 97 to about 90% by weight of the polyester composition.

As is well known to those skilled in the art, containers can be made by blow molding a container preform. Examples of suitable preform and container structures are disclosed in U.S. Pat. No. 5,888,598, the disclosure of which is expressly incorporated herein by reference in its entirety.

The carbonating agents are added to the polyester during the production of the preforms through either a one-step or two-step injection blow molding process. During a two-step injection stretch blow molding process, a polyester composition comprising the polyester and the carbonating agent is formed first and converted to a transportable form, like solid pellets, followed by heating the solid polyester composition and molding the polyester composition into a container perform. In forming the polyester composition, the carbonating agent and polyester are dried separately prior to mixing. The carbonating agent is then mixed with polyester and solidified to form pellets. Next, a preform is made from the polyester composition that contains the carbonating agents, utilizing techniques well known in the art, such as injection molding. Alternatively, the polyester and the carbonating agent can be dried separately and mixed prior to the injection molding to form preforms. The preforms molded from the polyester composition are then blown into containers using a commercial or lab blow molding machine. Certain adjustments in the blow molding conditions will be needed to make suitable containers. To those skilled in the art, the adjustments are a common practice. During a one-step injection stretch molding process, the carbonating agents are mixed with polyester prior to injection molding and preforms and bottles are produced thereafter. The containers are then filled with an aqueous carbonated beverage in accordance with conventional methods. In the containers, the aqueous carbonated beverage is in direct contact with the polyester composition which forms the containers.

Turning to FIG. 1, a container preform 110 is illustrated. This preform 110 is made by molding the polyester resin and comprises a threaded neck finish 112 which terminates at its lower end in a capping flange 114. Below the capping flange 114, there is a generally cylindrical section 116 which terminates in a section 118 of gradually increasing external diameter so as to provide for an increasing wall thickness. Below the section 118 there is an elongated body section 120.

Figure 2:
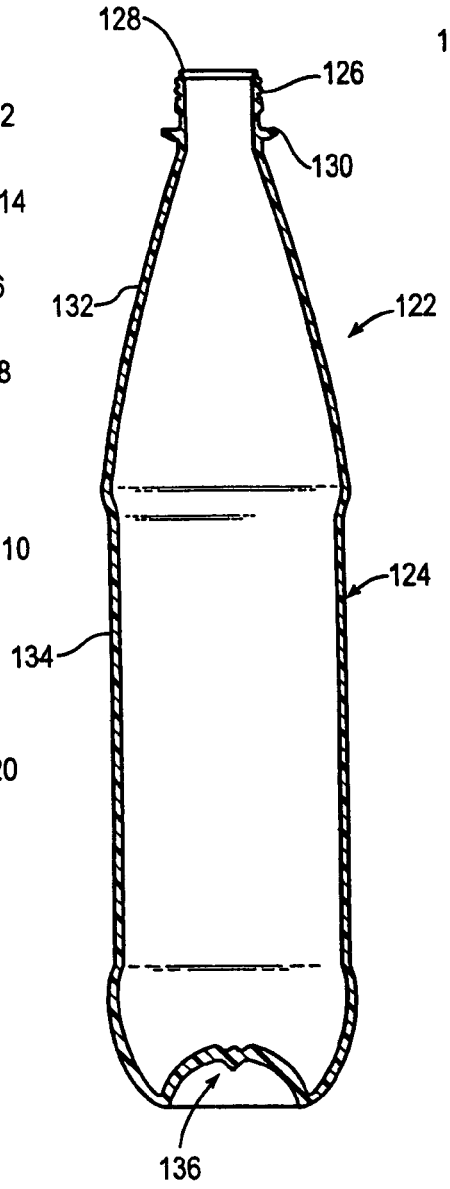
FIG. 2 is a sectional elevational view of a blow molded container made from the preform of FIG. 1 in accordance with an embodiment of this invention.
Figure 3:
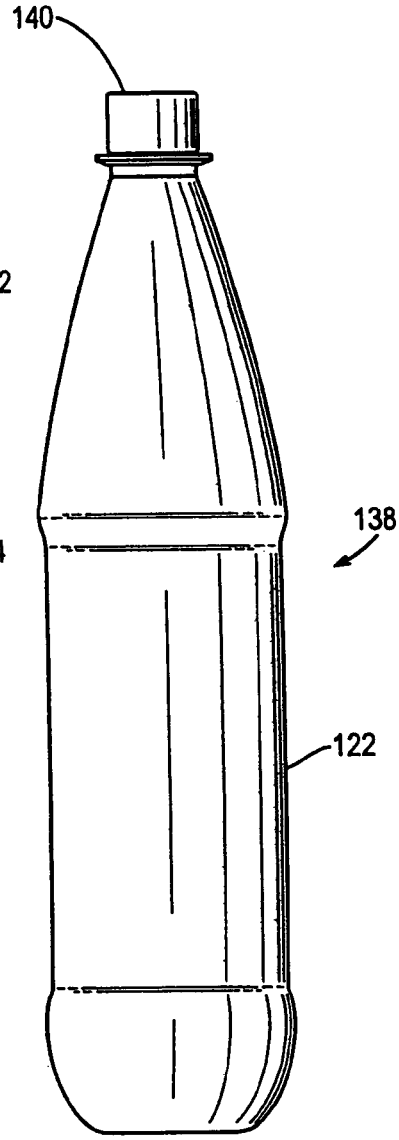
FIG. 3 is a perspective view of a packaged beverage made in accordance with an embodiment of this invention.
Figure 5:
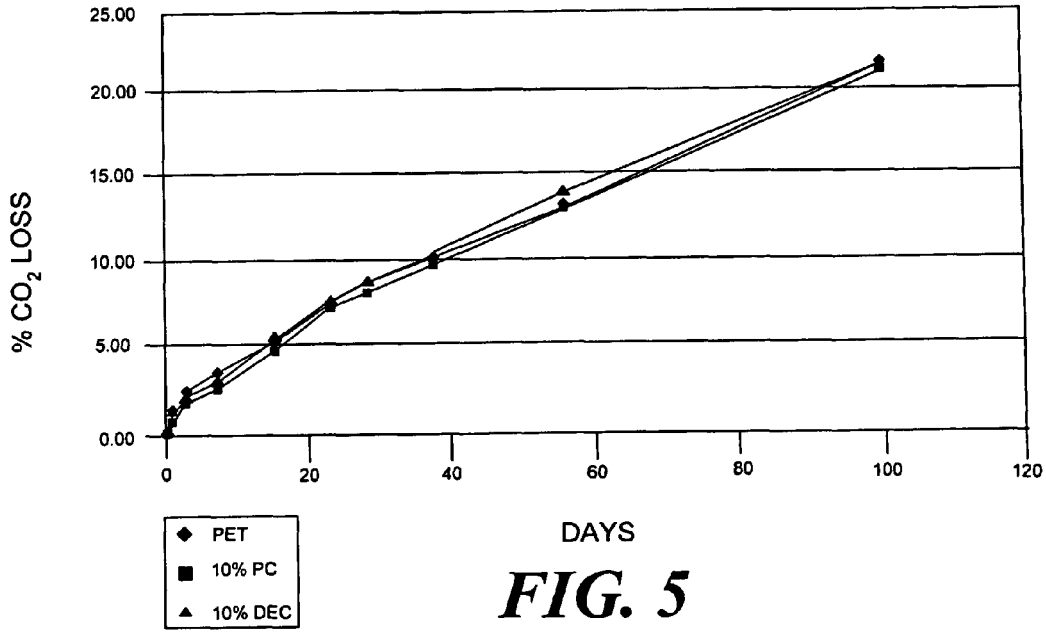
FIG. 5 is a graph comparing the % loss of $CO_2$ over time of PET containers with carbonating agents to PET containers without carbonating agents when the PET containers do not contain a carbonated aqueous beverage.

The preform 110 illustrated in FIG. 1 can be blow molded to form a container 122 illustrated in FIG. 2. The container 122 comprises a shell 124 comprising a threaded neck finish 126 defining a mouth 128, a capping flange 130 below the threaded neck finish, a tapered section 132 extending from the capping flange, a body section 134 extending below the tapered section, and a base 136 at the bottom of the container. The container 122 is suitably used to make a packaged beverage 138, as illustrated in FIG. 5. The packaged beverage 138 includes a beverage such as a carbonated soda beverage disposed in the container 122 and a closure 140 sealing the mouth 128 of the container.

The preform 110, container 122, and packaged beverage 138 are but examples of suitable embodiments of the present invention. It should be understood that the polyester composition of the present invention can be used to make preforms and containers having a variety of configurations.

When the aqueous carbonated beverage is packaged in such containers, the carbonating agent that is incorporated in the container sidewall slowly undergoes hydrolysis and releases $CO_2$. The hydrolysis occurs on the surface of the sidewall that has direct contact with water, or inside the sidewall through which water has diffused and been absorbed. Moisture from ambient air either does not hydrolyze the carbonating agent, or the hydrolysis is so slow that it does not have practical effect. The rate of hydrolysis and thus $CO_2$ release can be controlled via selecting different carbonating agents with different lengths of the alkylene groups. Since appreciable hydrolysis only occurs when there is liquid water in direct contact with the container, and the water content outside of the container is essentially zero, the hydrolysis occurs largely on the inside surface of the container that has direct contact with the aqueous carbonated beverage, and gradually reduces throughout the thickness of the sidewall. This ensures the diffusion of the $CO_2$ to the inside of the container rather than to the outside of the container.

The present invention is described above and further illustrated below by way examples which are not to be construed in any way as imposing limitations upon the scope of the invention. On the contrary, it is to be clearly understood that resort may be had to various other embodiments, modifications, and equivalents thereof which, after reading the description herein, may suggestion themselves to those skilled in the art that without departing from the scope of the invention and the appended claims.

EXAMPLES

Example 1

A commercial CSD grade PET copolyester, Kosa 1101, manufactured by Kosa at Spartanburg, S.C., was used as the polyester. Two carbonating agents were used to demonstrate the effect: propylene carbonate (CAS #108-32-7) and diethyl carbonate (CAS #105-58-8). The PET copolyester was dried overnight at 140° C. in a Conair hopper dryer before processing. The dried PET copolyester was then fed into the hopper of a Werner-Pfleiderer ZSK-30 twin screw extruder. Propylene carbonate and diethyl carbonate were used without drying. The propylene carbonate and diethyl carbonate were fed into the twin screw extruder through a PDI CH-83 metering pump in an amount 5 wt % and 10 wt % of the total weight of the polyester composition comprising the PET based resin and the carbonating agents. The processing temperature was kept at 270° C. The extrudants were passed through a water cooler and were converted into pellets. The melt viscosity of the different pellets were measured with a RDA III parallel plate Rheometer at 280° C. and 15% strain with a frequency sweep from 1.0 rad/second to 100 rad/second. An inherent viscosity (IV) of the pellets was calculated from the melt viscosity according to ASTM D 4603. IV is a measure of the molecular weight. When the IV is higher, the molecular weight is also higher. The pellet IV values are listed in Table 1.

TABLE 1

| Material description | IV (dL/g) |
|---|---|
| PET copolyester pellets | 0.75 |
| PET copolyester + 5 wt % propylene carbonate | 0.79 |
| PET copolyester + 10 wt % propylene carbonate | 0.77 |
| PET copolyester + 5 wt % diethyl carbonate | 0.77 |
| PET copolyester + 10 wt % diethyl carbonate | 0.78 |

Table 1 shows that there is no additional degradation of PET copolyester or IV drop caused by addition of the carbonating agents. This offers great advantage over some other barrier technologies, such as barrier additives or resins, which cause substantial degradation of polyesters.

Example 2

The PET copolyester pellets without any carbonating agents from Example 1 were vacuum dried at 140° C. for 16 hours. Dried materials were than processed through a single screw Haake Brabender at 280° C. using a sheet die and stacked chill rolls to produce 2.5 inch wide sheet samples for evaluation. The sheet was cut into 10-g pieces and put into 12-oz 26.5-g PET bottles. The bottles were then filled with an aqueous carbonated beverage with PH around 3, and $CO_2$ level between 3 to 4 volumes. The beverage fully immersed the pieces of sheet. The purpose of using 10-g of the sheet is to simulate a 12-oz bottle made from a PET copolyester. A 12-oz bottle has a weight from 24 to 27 g with a finish of 5 to 6 g, so the sidewall of a 12-oz bottle is around 20 to 22 g. In a bottle only one side of the bottle is in contact with aqueous product, while in a film immersed in an aqueous product, two sides contact the aqueous products, and thus only half of the amount is used. The bottles were stored at 22° C. The $CO_2$ level in the bottles, and thus the net loss of the $CO_2$ was measured by well-established Zahm-Nagle test at different time intervals. As can be seen from Table 2, 17.2% of the $CO_2$ was lost after 43 days.

TABLE 2

$CO_2$ loss rate for PET control sheet

| Time (days) | Volume % loss of $CO_2$ |
|---|---|
| 1 | 0 |
| 8 | 6.13 |
| 15 | 12.17 |
| 30 | 15.54 |
| 43 | 17.20 |

The values in Table 2 are very similar to what was obtained in the 12-oz bottle without pieces of sheet.

Example 3

The PET copolyester pellets containing 10 wt % of propylene carbonate as in Example 1 were dried in a vacuum oven at 140° C. overnight. The dried materials were processed into a sheet using the same methods as in Example 2. The sheet was cut to 10-g pieces and put into 12-oz 26.5-g bottles. These bottles were then filled with an aqueous carbonated beverage with a pH around 3 and a $CO_2$ level between 3 to 4 volumes. The sheets were fully immersed in the beverage. The bottles were stored at 22° C. and the $CO_2$ loss was measured using a Zahm-Nagle method as in Example 2. As can be seen in Table 3, after 43 days, only 12% of $CO_2$ was lost as compared to 17.2% with PET copolyester without propylene carbonate additives.

TABLE 3

$CO_2$ loss rate for 10 wt % propylene carbonate containing sheet

| Time (days) | Volume % loss rate of $CO_2$ |
|---|---|
| 1 | 0 |
| 8 | 1.61 |
| 15 | 7.43 |
| 30 | 9.70 |
| 43 | 12.00 |

Example 4

The PET copolyester pellets containing 10 wt % of diethyl carbonate as in Example 1 were dried in a vacuum oven at 140° C. overnight. The dried materials were processed into a sheet using the same methods as in Example 2. The sheet was cut to 10-g pieces and put into 12-oz 26.5-g bottles. These bottles were then filled with an aqueous carbonated beverage with a pH around 3 and a $CO_2$ level between 3 to 4 volumes. The sheets were fully immersed in the beverage. The bottles were stored at 22° C. and the $CO_2$ loss was measured using a Zahm-Nagle method as in Example 2. As can be seen in Table 3, after 43 days, only 12% of $CO_2$ was lost as compared to 17.2% with PET copolyester without diethyl carbonate additives.

TABLE 4

$CO_2$ loss rate for 10% diethyl carbonate containing sheet

| Time (days) | Volume % loss rate of $CO_2$ |
|---|---|
| 1 | 0 |
| 8 | 5.25 |
| 15 | 4.52 |
| 30 | 9.71 |
| 43 | 12.00 |

Example 5

The PET copolyester pellets from Example 1 were crystallized in a Conair hopper dryer for two hours at 140° C. and then removed from the dryer to remove any clumps. After that, the pellets were dried at 140° C. in a Conair hopper dryer overnight. The dried pellets were fed into an Arburg 320S injection molding machine equipment with a single cavity preform die. All temperature zones of the injection molding machine were maintained at 280° C. The IV of the preforms were measured and are shown in Table 5.

TABLE 5

IV of the preforms

| Preform description | IV (dL/g) |
|---|---|
| PET copolyester | 0.66 |
| PET copolyester + 5 wt % propylene carbonate | 0.68 |
| PET copolyester + 10 wt % propylene carbonate | 0.73 |
| PET copolyester + 5 wt % diethyl carbonate | 0.67 |
| PET copolyester + 10 wt % diethyl carbonate | 0.68 |

It is seen from Table 5 that the added carbonating agents did not cause addition degradation or IV drop to PET copolyester.

Comparative Example 1

The following preforms from Example 5 were blown into 2-L generic bottles with a lab scale blow molding machine: PET copolyester, PET copolyester with 10 wt % propylene carbonate, and PET copolyester with 10 wt % diethyl carbonate. 10-g of each bottle sidewall was cut into sheets and put in 390 ml, 27-g bottles. The bottles were then filled with dry ice to yield between 3 to 4 volumes of $CO_2$. 3-g of ice was also added to each bottle to create a 100% RH inside the bottles. The amount of water, however, was not enough to immerse the sheets. The water barely covered the bottom of the bottles. The filled bottles were stored at 22° C. The $CO_2$ levels inside the bottles were measured with a near device as described in U.S. Pat. No. 5,473,161. The $CO_2$ loss rate was in Table 6.

TABLE 6

$CO_2$ loss rate for bottles without water

| Days | PET copolyester | PET copolyester + 10% propylene carbonate | PET copolyester + 10% diethyl carbonate |
|---|---|---|---|
| 0 | 0 | 0 | 0 |
| 1 | 1.18 | 0.59 | 1.25 |
| 3 | 2.12 | 1.56 | 2.01 |
| 7 | 3.85 | 3.19 | 3.50 |
| 13 | 5.18 | 4.67 | 5.41 |
| 21 | 6.89 | 6.60 | 6.99 |
| 28 | 8.81 | 8.03 | 8.85 |
| 36 | 10.12 | 9.79 | 10.15 |
| 51 | 12.82 | 12.69 | 13.48 |
| 101 | 21.10 | 20.66 | 21.06 |

It is seen from Table 6 that there is essentially no difference in loss rate for different variables. Therefore, the presence of water is essential for the $CO_2$ generation reaction to occur. Only water vapor is not enough for the reaction to occur, or the reaction rate is so slow that it can't be detected. Therefore, water vapor will not generate $CO_2$.

Figure 4:
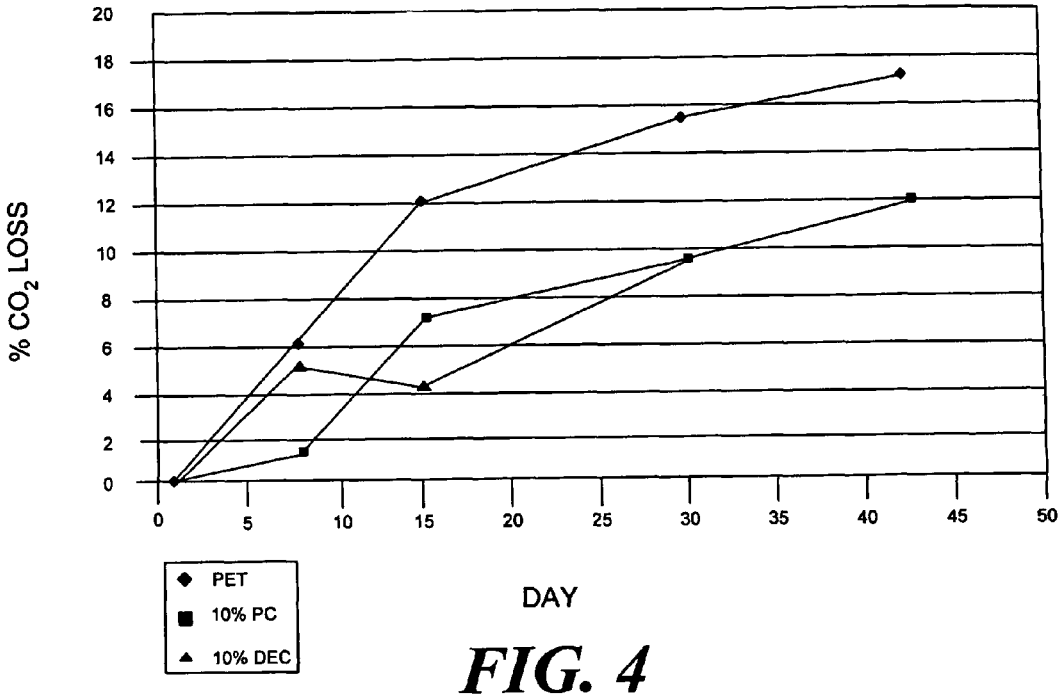
FIG. 4 is a graph comparing the % loss of $CO_2$ over time of PET containers with carbonating agents to PET containers without carbonating agents when the PET containers contain a carbonated aqueous beverage.

FIG. 4 is a graphical representation of the data from Tables 2-4 comparing the % loss of $CO_2$ over time of PET copolyester containers with carbonating agents to PET copolyester containers without carbonating agents and demonstrates the effect of the carbonating agent that is incorporated into PET copolyester. FIG. 5 is a graphical representation of the data from Table 6 comparing the % loss of $CO_2$ over time of PET copolyester containers with carbonating agents to PET copolyester containers without carbonating agents when the PET copolyester containers do not contain an aqueous carbonated beverage. FIG. 5 shows that the carbonating agents do not work without contact with an aqueous carbonated beverage.

It should also be understood that the foregoing relates to particular embodiments of the present invention, and that numerous changes may be made therein without departing from the scope of the invention as defined by the following claims.

I claim:

1. A packaged beverage comprising:

a container comprising a polyester composition comprising a polyester suitable for packaging aqueous carbonated beverages and a carbonating agent, wherein the carbonating agent is an alkylene carbonate;

an aqueous carbonated beverage disposed in the container such that the aqueous carbonated beverage has direct contact with the container; and a closure for sealing the aqueous carbonated beverage in the container, wherein the carbonating agent reacts with water in the aqueous carbonated beverage forming $CO_2$ for replacing at least a portion of $CO_2$ that permeates through the container or the closure.

2. A packaged beverage comprising:

a container comprising a polyester composition comprising a polyester suitable for packaging aqueous carbonated beverages and a carbonating agent, wherein the carbonating agent is a dialkane carbonate;

an aqueous carbonated beverage disposed in the container such that the aqueous carbonated beverage has direct contact with the container; and a closure for sealing the aqueous carbonated beverage in the container, wherein the carbonating agent reacts with water in the aqueous carbonated beverage forming $CO_2$ for replacing at least a portion of $CO_2$ that permeates through the container or the closure.

3. The packaged beverage of claim 1 wherein the alkylene carbonate is selected from propylene carbonate, 1,3 butylene carbonate, diethyl carbonate and neo-pentylene carbonate.

4. A packaged beverage comprising:

a container comprising a polyester composition comprising a polyester suitable for packaging aqueous carbonated beverages and a carbonating agent, wherein the carbonating agent is an aliphatic polycarbonate;

an aqueous carbonated beverage disposed in the container such that the aqueous carbonated beverage has direct contact with the container; and a closure for sealing the aqueous carbonated beverage in the container, wherein the carbonating agent reacts with water in the aqueous carbonated beverage forming $CO_2$ for replacing at least a portion of $CO_2$ that permeates through the container or the closure.

5. The packaged beverage of claim 1 wherein the polyester composition comprises a poly(ethylene terephthalate) based copolyester having less than 20 mole % diacid and/or 10 mole % diol modification, based on 100 mole % diacid component and 100 mole % diol component.

6. The packaged beverage of claim 1 wherein the carbonating agent is present in the polyester composition in an amount from about 1 to about 15% by weight of the polyester composition.

7. The packaged beverage of claim 2 wherein the carbonating agent is present in the polyester composition in an amount from about 1 to about 15% by weight of the polyester composition.

8. The packaged beverage of claim 4 wherein the carbonating agent is present in the polyester composition in an amount from about 1 to about 15% by weight of the polyester composition.

9. The packaged beverage of claim 1 wherein the carbonating agent is present in the polyester composition in an amount from about 1 to about 15% by weight of the polyester composition and the polyester is present in the polyester composition in an amount from about 99 to about 85% by weight of the polyester composition.

10. The packaged beverage of claim 2 wherein the carbonating agent is present in the polyester composition in an amount from about 1 to about 15% by weight of the polyester composition and the polyester is present in the polyester composition in an amount from about 99 to about 85% by weight of the polyester composition.

11. The packaged beverage of claim 4 wherein the carbonating agent is present in the polyester composition in an amount from about 1 to about 15% by weight of the polyester composition and the polyester is present in the polyester composition in an amount from about 99 to about 85% by weight of the polyester composition.

12. The packaged beverage of claim 1 wherein the container is a rigid container comprising a base, an open ended mouth, and a body extending from the base to the open ended mouth.

13. A method for packaging a beverage comprising the steps of:

filling a container with an aqueous carbonated beverage such that the aqueous carbonated beverage has direct contact with the container, the container comprising a polyester composition comprising a polyester suitable for packaging aqueous carbonated beverages and a carbonating agent, wherein the carbonating agent is an alkylene carbonate; and sealing the aqueous carbonated beverage in the container with a closure, wherein the carbonating agent reacts with water in the aqueous carbonated beverage forming $CO_2$ for replacing at least a portion of $CO_2$ that permeates through the container or the closure.

14. A method for packaging a beverage comprising the steps of:

filling a container with an aqueous carbonated beverage such that the aqueous carbonated beverage has direct contact with the container, the container comprising a polyester composition comprising a polyester suitable for packaging aqueous carbonated beverages and a carbonating agent, wherein the carbonating agent is a dialkane carbonate; and sealing the aqueous carbonated beverage in the container with a closure, wherein the carbonating agent reacts with water in the aqueous carbonated beverage forming $CO_2$ for replacing at least a portion of $CO_2$ that permeates through the container or the closure.

15. The method of claim 13 wherein the alkylene carbonate is selected from propylene carbonate, 1,3 butylene carbonate, diethyl carbonate and neo-pentylene carbonate.

16. A method for packaging a beverage comprising the steps of:

filling a container with an aqueous carbonated beverage such that the aqueous carbonated beverage has direct contact with the container, the container comprising a polyester composition comprising a polyester suitable for packaging aqueous carbonated beverages and a carbonating agent, wherein the carbonating agent is an aliphatic polycarbonate; and sealing the aqueous carbonated beverage in the container with a closure, wherein the carbonating agent reacts with water in the aqueous carbonated beverage forming $CO_2$ for replacing at least a portion of $CO_2$ that permeates through the container or the closure.

17. The packaged beverage of claim 2 wherein the polyester composition comprises a poly(ethylene terephthalate) based copolyester having less than 20 mole % diacid and/or 10 mole % diol modification, based on 100 mole % diacid component and 100 mole % diol component.

18. The packaged beverage of claim 2 wherein the container is a rigid container comprising a base, an open ended mouth, and a body extending from the base to the open ended mouth.

19. The packaged beverage of claim 4 wherein the polyester composition comprises a poly(ethylene terephthalate) based copolyester having less than 20 mole % diacid and/or 10 mole % diol modification, based on 100 mole % diacid component and 100 mole % diol component.

20. The packaged beverage of claim 4 wherein the container is a rigid container comprising a base, an open ended mouth, and a body extending from the base to the open ended mouth.

* * * * *